US012474131B2

(12) United States Patent
Hell et al.

(10) Patent No.: US 12,474,131 B2
(45) Date of Patent: Nov. 18, 2025

(54) FRAME ASSEMBLY FOR A FIREARM

(71) Applicant: Glock Technology GmbH, Ferlach (AT)

(72) Inventors: Sebastian Hell, Weikendorf (AT); Juergen Gunsam, Prottes (AT); Josef Kroyer, Zemendorf (AT); Markus Karlo, Vienna (AT); Ralph Morgenfurt, Auersthal (AT); Thomas Mayrhauser, St. Florian (AT)

(73) Assignee: Glock Technology GmbH (AT)

( * ) Notice: Subject to any disclaimer, the term of this patent is extended or adjusted under 35 U.S.C. 154(b) by 0 days.

(21) Appl. No.: 18/723,406

(22) PCT Filed: Dec. 22, 2022

(86) PCT No.: PCT/AT2022/060459
§ 371 (c)(1),
(2) Date: Jun. 21, 2024

(87) PCT Pub. No.: WO2023/115092
PCT Pub. Date: Jun. 29, 2023

(65) Prior Publication Data

US 2025/0164199 A1 May 22, 2025

(30) Foreign Application Priority Data

Dec. 23, 2021 (EP) ..... 21217338

(51) Int. Cl.
*F41A 3/66* (2006.01)
*F41C 3/00* (2006.01)

(52) U.S. Cl.
CPC . *F41A 3/66* (2013.01); *F41C 3/00* (2013.01)

(58) Field of Classification Search
CPC .. F41C 3/00; F41C 23/10; F41C 23/14; F41C 23/16; F41A 3/66; F41A 11/00; F41A 11/02
See application file for complete search history.

(56) References Cited

U.S. PATENT DOCUMENTS 5,437,118 A * 8/1995 Sniezak ..... F41C 23/10 42/7
D584,374 S * 1/2009 McGarry ..... D22/104
(Continued)

FOREIGN PATENT DOCUMENTS

DE 10312761 B3 8/2004
EP 1870660 A1 12/2007

OTHER PUBLICATIONS

English abstract for EP1870660.
English abstract for DE10312761.

*Primary Examiner* — Joshua E Freeman
(74) *Attorney, Agent, or Firm* — Fishman Stewart PLLC

(57) ABSTRACT

A receiver assembly for a handgun. The receiver assembly includes an upper receiver portion, a lower receiver portion, and a locking mechanism. The upper receiver portion includes i) a guide rail for receiving a slide assembly and ii) a magazine compartment for receiving a magazine. The magazine compartment defines a magazine insertion direction, and the magazine is pushable into the magazine compartment in the magazine insertion direction. The lower receiver portion is slidable onto the upper receiver portion in the magazine insertion direction. The locking mechanism is configured to couple the lower receiver portion to the upper receiver portion. The locking mechanism includes a locking element that is structurally independent. The locking element includes a contact projection and a locking projection. The contact projection form-fittingly engages with the lower
(Continued)

receiver portion and the locking projection form-fittingly engages with the upper receiver portion.

20 Claims, 10 Drawing Sheets

(56) References Cited

U.S. PATENT DOCUMENTS

| | | | | |
|---|---|---|---|---|
| 7,743,542 | B1 * | 6/2010 | Novak | F41A 9/24 42/49.02 |
| 8,186,089 | B2 * | 5/2012 | Werner | F41C 23/10 42/71.02 |
| 10,724,824 | B1 * | 7/2020 | Lister | F41C 23/12 |
| 11,079,189 | B2 * | 8/2021 | Hsu | F41A 3/66 |
| 2006/0096147 | A1 * | 5/2006 | Gussalli Beretta | F41C 23/10 42/71.02 |
| 2008/0060247 | A1 * | 3/2008 | Thomele | F41A 3/66 42/71.02 |
| 2010/0132238 | A1 * | 6/2010 | Werner | F41C 23/10 42/71.02 |
| 2012/0055060 | A1 * | 3/2012 | Hines | F41C 23/16 42/71.01 |
| 2013/0205635 | A1 * | 8/2013 | Hines | F41C 23/16 42/71.02 |
| 2017/0191784 | A1 * | 7/2017 | Kroyer | F41A 5/02 |
| 2019/0107348 | A1 * | 4/2019 | Harrigan | F41A 3/66 |
| 2019/0331445 | A1 * | 10/2019 | Full | F41A 19/11 |
| 2020/0363158 | A1 * | 11/2020 | Glen | F41A 3/66 |
| 2021/0116194 | A1 * | 4/2021 | Tai | F41C 23/10 |
| 2021/0172691 | A1 * | 6/2021 | Hsu | F41A 9/71 |
| 2021/0222994 | A1 * | 7/2021 | Murphy, II | F41A 17/54 |
| 2023/0272988 | A1 * | 8/2023 | Curry | F41C 23/10 42/69.03 |

* cited by examiner

FRAME ASSEMBLY FOR A FIREARM

CROSS REFERENCE TO RELATED APPLICATIONS

This application is a US National Phase Application of PCT/AT2022/060459, filed Dec. 22, 2022, which claims priority to EP-21217338.9, filed Dec. 23, 2021. The contents of both these application are hereby incorporated by reference in their entirety.

TECHNICAL FIELD

The invention relates to a receiver assembly for a handgun and to a handgun equipped with the receiver assembly.

BACKGROUND

The handgun according to the invention may be a pistol.

Handgun users vary in physique. In particular, the hands of the users of handguns are of different sizes. The need to be able to adapt the handgun to different users has existed for a long time. In addition, the handgun should have a simple and robust structure. It is also advantageous if the handgun takes up little space in the dismantled state, for example for transport purposes.

U.S. Pat. No. 8,186,089 B2 discloses an interchangeable attachment device for a pistol receiver with a grip into which a magazine provided with a magazine base can be inserted, wherein the receiver has a front region close to the grip and a rear region remote from the grip. At least one attachment element is provided in the rear and front region of the receiver for interacting with a rear and front attachment device of a grip attachment for fastening the grip attachment to the receiver, wherein at least one eyelet device is also provided in the rear region of the receiver, which, when the grip attachment is on the receiver, engages in a form-fitting manner in a bore of the grip attachment, into which a locking pin can be detachably introduced to detachably connect the grip attachment to the receiver.

The handgun disclosed in U.S. Pat. No. 8,186,089 B2 has the disadvantage that the attachment element can only be removed from the receiver with difficulty. In addition, the receiver of the handgun still has a relatively large vertical extent even when the attachment element has been removed.

EP 1870660 B1 discloses a receiver for a handgun, in particular a pistol, comprising a grip module made of plastics material and a metal carrier element that can be inserted into the grip module. In order to allow adaptation to the most diverse requirements of the shooter, a magazine shaft protruding downwards from the grip module is formed on the carrier element and a grip shell module is plugged onto it.

The handgun disclosed in EP 1870660 B1 has the disadvantage that the carrier element has a complex structure and increases the weight of the handgun. In addition, the handgun still has a large vertical extension even when the grip shell module is removed.

Other handguns having modular receivers are known from DE 10312761 B3 and U.S. Ser. No. 11/079,189 B2.

SUMMARY

The object of the present invention was to overcome the disadvantages of the prior art and to specify an improved receiver assembly for a handgun, as well as to provide a handgun equipped with the receiver assembly.

This object is achieved by a receiver assembly and a handgun according to the claims.

A receiver assembly for a handgun is formed according to the invention. The receiver assembly comprises:

- an upper receiver portion, wherein the upper receiver portion has a guide rail for receiving a slide assembly, wherein the upper receiver portion has a magazine compartment for receiving a magazine, wherein the magazine compartment defines a magazine entry direction, wherein the magazine can be inserted into the magazine compartment in the magazine entry direction when the handgun is in use;
- a lower receiver portion, wherein the lower receiver portion can be slid onto the upper receiver portion in the magazine entry direction and can be coupled thereto;
- a locking mechanism for coupling the lower receiver portion to the upper receiver portion.

The locking mechanism comprises a structurally independent locking element, wherein the locking element has a contact projection which engages in a form-fitting manner in the lower receiver portion, and wherein the locking element has a locking projection which engages in a form-fitting manner in the upper receiver portion.

The receiver assembly according to the invention brings with it the advantage that the lower receiver portion may be coupled to the upper receiver portion as rigidly as possible and yet relatively easily detachably by means of the structurally independently designed locking element. In particular, the locking element can achieve a stable connection between the lower receiver portion and the upper receiver portion. Thus, the receiver assembly can be easily adapted to different users.

The locking projection within the meaning of this document can be any structural configuration which serves to form a form-fitting connection with the upper receiver portion and thus enable absorption of forces acting in the magazine entry direction.

The contact projection within the meaning of this document can be any structural configuration which serves to form a form-fitting connection with the lower receiver portion and thus enable absorption of forces acting in the magazine entry direction.

Furthermore, it can be provided that the locking element is designed to be flexible, so that the locking projection can be displaced or bent relative to the contact projection.

It can also be expedient if the locking element is designed in the form of a leaf spring which has a spring base and a spring arm, wherein the contact projection is arranged on the spring base, and the locking projection is arranged on the spring arm, wherein the spring arm is designed to be elastically flexible. In particular, a locking element in the form of a leaf spring can have a simple structure and also have good functionality at the same time.

Furthermore, it can be provided that a locking recess is formed in the upper receiver portion, in which the locking projection engages, wherein the locking recess extends to the magazine compartment, wherein the locking projection is detachable from the magazine compartment. Particularly in the case of a receiver assembly designed in this way, the lower receiver portion can be easily removed from the upper receiver portion. As a result of these measures, in particular that the locking projection can be released from the magazine compartment, it can be achieved that the locking projection can only be released when there is no magazine in the magazine compartment.

In an alternative embodiment variant, it can be provided that a latching lug is formed in the upper receiver portion and that a window is formed in the locking element, in which window the latching lug engages, wherein the locking projection is formed by an upper edge of the recess in the locking element.

In particular, it can be provided that the latching lug has a latching ramp. The latching ramp can be used to allow the locking element to be pushed over the latching lug when the lower receiver portion is joined to the upper receiver portion until the latching lug engages in the window.

In addition, it can be provided that a receiving space for receiving the locking element is formed in the lower receiver portion, the receiving space being delimited by an outer casing of the lower receiver portion and an intermediate wall of the lower receiver portion that delimits the magazine compartment. This has the advantage that the locking element can be positioned at a suitable position on the lower receiver portion so that it cannot be accessed from the outside when the handgun is installed or when it is being used.

Also advantageous is an embodiment according to which it can be provided that a rechargeable battery receptacle is formed in the receiving space or on the locking element, which rechargeable battery receptacle serves to receive a rechargeable battery for the power supply of the receiver assembly or other power-supplied elements of the handgun. In this way, power can be supplied to the receiver assembly or, for example, to energy consumers mounted on the receiver, such as a light or a shot counter, in a relatively simple manner, in order to allow the receiver assembly to have additional functionality. In particular, these measures allow the rechargeable battery to be stowed away well and accommodated in the receiver assembly so that it can be easily replaced.

According to a refinement, it is possible for the receiving space to be arranged in the lower receiver portion on a rear receiver side. In particular on the rear receiver side, the receiving space can be well integrated into the receiver assembly or in the lower receiver portion, while at the same time the external shape of the receiver assembly is not negatively influenced by the provision of the receiving space and can therefore be better adapted to the ergonomic requirements.

Furthermore, it can be expedient if a further spring arm is formed on the locking element in the region of the locking projection, wherein the further spring arm is supported on an outer casing of the lower receiver portion. Through this measure, an increase in the holding force of the locking element on the upper receiver portion can be achieved.

In an alternative embodiment, it can be provided that a spring element which acts on the locking element is formed in the upper receiver portion or in the lower receiver portion. The locking projection can be pressed into a corresponding counter-element in the upper receiver portion by means of the spring element. The spring element can be designed in the form of a leaf spring or in the form of a helical spring.

In addition, it can be provided that a support element is formed on the locking element in the region of the contact projection, wherein the support element is supported on an outer casing of the lower receiver portion. This has the advantage that the locking element can be accommodated in the lower receiver portion in a form-fitting manner by means of the support element. As a result, undesired movements of the locking element relative to the lower receiver portion, such as a loose fit, can be largely prevented.

In particular, it can be provided that a first support element and a second support element are formed on the locking element in the region of the contact projection, wherein the first support element and the second support element have a different shape.

Furthermore, it can be provided that the support element is formed on the spring base opposite the contact projection.

Provision can also be made for the upper receiver portion to have a stop, wherein a hollow cylinder portion is formed in the upper receiver portion, which completely surrounds the magazine compartment and which extends between a lower edge of the upper receiver portion and the stop, wherein the lower receiver portion has an insertion space in which the hollow cylinder portion is accommodated, wherein an upper edge of the lower receiver portion bears against the peripheral stop of the upper receiver portion. This measure allows a stable connection to be achieved between the upper receiver portion and the lower receiver portion. In particular, tilting moments and forces acting on the upper receiver portion can be easily transferred to the lower receiver portion due to these measures. In addition, as a result of this measure, the upper receiver portion can have the smallest possible height extent, so that a dismantled handgun can have the smallest possible spatial extent. In particular, this measure makes it conceivable that the lower receiver portion can simply be pushed onto the upper receiver portion in the magazine entry direction. The stop means that the lower receiver portion can be positioned precisely relative to the upper receiver portion.

In particular, it can be provided that a grip surface on which a user holds the handgun is largely formed on the lower receiver portion. In this way, the exchangeable lower receiver portion can be adapted well to the corresponding user, in particular to the shape and size of his hand. As a result, the handling or the ergonomics of the handgun can be improved.

In addition, it can be provided that more than 60%, preferably more than 70%, in particular more than 80% of the peripheral stop is arranged in one stop plane.

According to a particular embodiment, it is possible for a guide groove which extends in the magazine entry direction to be formed on an outer lateral surface of the hollow cylinder portion, wherein a guide projection is formed on an inner lateral surface of the lower part of the grip, which corresponds to the guide groove. This measure can improve the stability of the connection between the upper receiver portion and the lower receiver portion.

According to an advantageous development, it can be provided that a left-hand guide groove is formed on a left-hand side of the hollow cylinder portion, and that a right-hand guide groove is formed on a right-hand side of the hollow cylinder portion, wherein a left-hand guide projection is formed on a left-hand side of the lower receiver portion, which corresponds to the left-hand guide groove, and a right-hand guide projection is formed on a right-hand side of the lower receiver portion, which corresponds to the right-hand guide groove. This measure can improve the stability of the connection between the upper receiver portion and the lower receiver portion.

In particular, it can be advantageous if the upper receiver portion has a receiving block for a return spring of a magazine holder in the region of the lower edge, wherein the receiving block is designed to project downwards relative to the lower edge, wherein a recess is formed in the lower receiver portion to receive the receiving block. With this measure, the return spring of the magazine holder can be positioned easily and functionally in the upper receiver portion.

Furthermore, it can be provided that the locking element has a fastening tab which has a fastening bore. The handgun can be easily secured to the user by means of the fastening tab via the locking element inserted into the handgun.

Furthermore, it can be provided that the fastening tab is arranged on the spring base.

In addition, it can be provided that a latching lug is formed on a front side of the lower receiver portion, which corresponds to a latching recess in the upper receiver portion. This measure can improve the stability of the connection between the upper receiver portion and the lower receiver portion.

A handgun is formed according to the invention. The handgun comprises:

a. a receiver assembly;

b. a slide assembly, wherein the slide assembly is received on the receiver assembly. The receiver assembly is formed in accordance with one of the above features.

Furthermore, it can be provided that the height of the hollow cylinder is between 15 mm and 35 mm, in particular between 18 mm and 30 mm, preferably between 22 mm and 28 mm.

Furthermore, it can be provided that the locking recess has a recess width of between 2 mm and 25 mm, in particular between 8 mm and 20 mm, preferably between 11 mm and 15 mm.

Provision can furthermore be made for the locking recess to have a recess height of between 2 mm and 25 mm, in particular between 8 mm and 20 mm, preferably between 10 mm and 14 mm.

In particular, it can be provided that the locking recess is designed in such a way that the locking projection can be actuated by the user's finger from the magazine compartment.

In an alternative embodiment, it can be provided that the locking recess is designed in such a way that the locking projection can be actuated by means of a tool. In particular, it can be provided in this case that a pin-shaped opening tool is formed, which can be pushed into the locking recess.

Provision can also be made for a gradation to be formed at least in sections on the lower edge of the upper receiver portion, which engages in a form-fitting manner in the lower receiver portion. This has the advantage that the stability of the connection between the upper receiver portion and the lower receiver portion can be improved.

Provision can also be made for a gradation to be formed at least in sections on the lower edge of the upper receiver portion, which engages in a form-fitting manner in the lower receiver portion. This has the advantage that the stability of the connection between the upper receiver portion and the lower receiver portion can be improved.

Provision can also be made for a gradation to be formed at least in sections on the upper edge of the lower receiver portion, which engages in a form-fitting manner in the upper receiver portion. This has the advantage that the stability of the connection between the upper receiver portion and the lower receiver portion can be improved.

Furthermore, it can be provided that a grip region for grasping the receiver assembly by the user is formed entirely on the lower receiver portion.

Furthermore, provision can be made for exchangeable elements to be arranged on the lower receiver portion, which elements can optionally be removed or exchanged from the lower receiver portion.

A slide in the sense of this document is also often referred to as a breech. In addition to the actual slide, the slide assembly also includes components attached to it.

Position information given in the claims of components of the handgun or their components relative to one another relates to an assembled and operational state of the handgun.

For a better understanding of the invention, it is explained in more detail with reference to the following figures.

BRIEF DESCRIPTION OF THE DRAWINGS

Each shows a greatly simplified schematic illustration:

FIG. 3 shows a first perspective view of the first embodiment of the upper receiver portion of the handgun;

DETAILED DESCRIPTION

By way of introduction, it should be noted that in the differently described embodiments, the same parts are provided with the same reference symbols or the same component names, and the disclosures contained in the entire description may be transferred accordingly to the same parts with the same reference symbols or the same component names.

Figure 1:
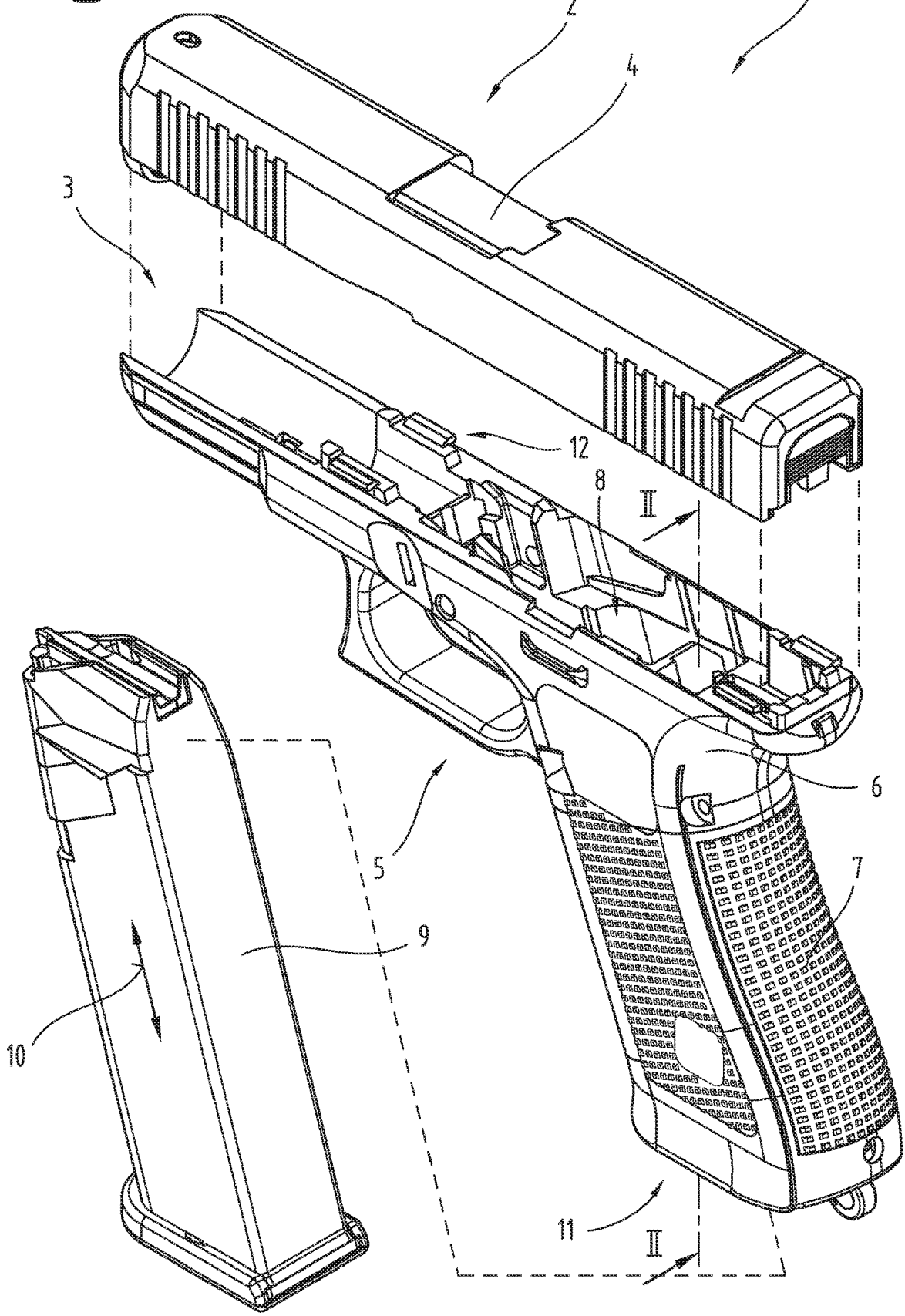
FIG. 1 is an exploded view of a first embodiment of a handgun in a perspective view.

FIG. 1 shows in a perspective view an exploded view of a first embodiment of a handgun 1.

As can be seen from FIG. 1, it can be provided that the handgun 1 comprises a slide assembly 2. It can also be provided that the handgun 1 comprises a receiver assembly 3. The slide assembly 2 and the receiver assembly 3 are shown spaced apart from one another in the illustration according to FIG. 1.

In particular, it can be provided that, in the state of use of the handgun 1, the slide assembly 2 is coupled to the receiver assembly 3.

The slide assembly 2 may comprise a barrel 4. The receiver assembly 3 can comprise a receiver 5.

As can be seen from FIG. 1, it can be provided that the receiver 5 comprises an upper receiver portion 6 and a lower receiver portion 7. In particular, provision can be made for the upper receiver portion 6 and the lower receiver portion 7 to be coupled to one another so that they can be dismantled. It can preferably be provided that the upper receiver portion 6 and the lower receiver portion 7 can be disassembled from one another without tools.

A magazine compartment 8 can be formed in the upper receiver portion 6, which magazine compartment is used to receive a magazine 9 inserted therein. The magazine 9 is inserted into the receiver 5 in a magazine entry direction 10. In particular, it can be provided that the lower receiver portion 7 is hollow or has a magwell 11. The magwell 11 can form an extension of the magazine compartment 8. The magwell 11 and the magazine compartment 8 can be used to receive the magazine 9 when the handgun 1 is in the assembled state.

As can also be seen from FIG. 1, it can be provided that a guide rail 12 for receiving the slide assembly 2 is formed directly on the upper receiver portion 6. The guide rail 12 can comprise guide elements which can be cast into the upper receiver portion 6. As an alternative to this, the guide rail 12 can comprise guide elements which can be formed in one piece with the upper receiver portion 6. In particular, provision can be made for the lower receiver portion 7 to be detachably coupled to the upper receiver portion 6, wherein the guide rail 12 for receiving the slide assembly 2 is formed on the upper receiver portion 6.

As can be seen particularly well from FIG. 1, it can be provided that the lower receiver portion 7 has such a large extent that the handgun 1 is gripped to a large extent or almost exclusively on the lower receiver portion 7. By this measure, the lower receiver portion 7 can be exchanged for the upper receiver portion 6 in order to be able to adapt the handgun 1 for use by different users. Furthermore, such a division between the upper receiver portion 6 and the lower receiver portion 7 means that the handgun 1 has a small vertical extent in the dismantled state, in particular when the lower receiver portion 7 has been removed. As a result, the portability of the handgun 1 can be improved.

In particular, it can be provided that the receiver upper portion 6 is in the form of an injection-molded part made of plastics material. Furthermore, it can be provided that the lower receiver portion 7 is designed in the form of an injection-molded part made of plastics material.

The handgun 1, in particular the slide assembly 2 and the receiver assembly 3, can of course comprise other customary components known to a person skilled in the art, such as a trigger, etc., wherein reference is made here to the general knowledge of a person skilled in the art, and these components will therefore not be described separately for the sake of clarity.

Figure 2:
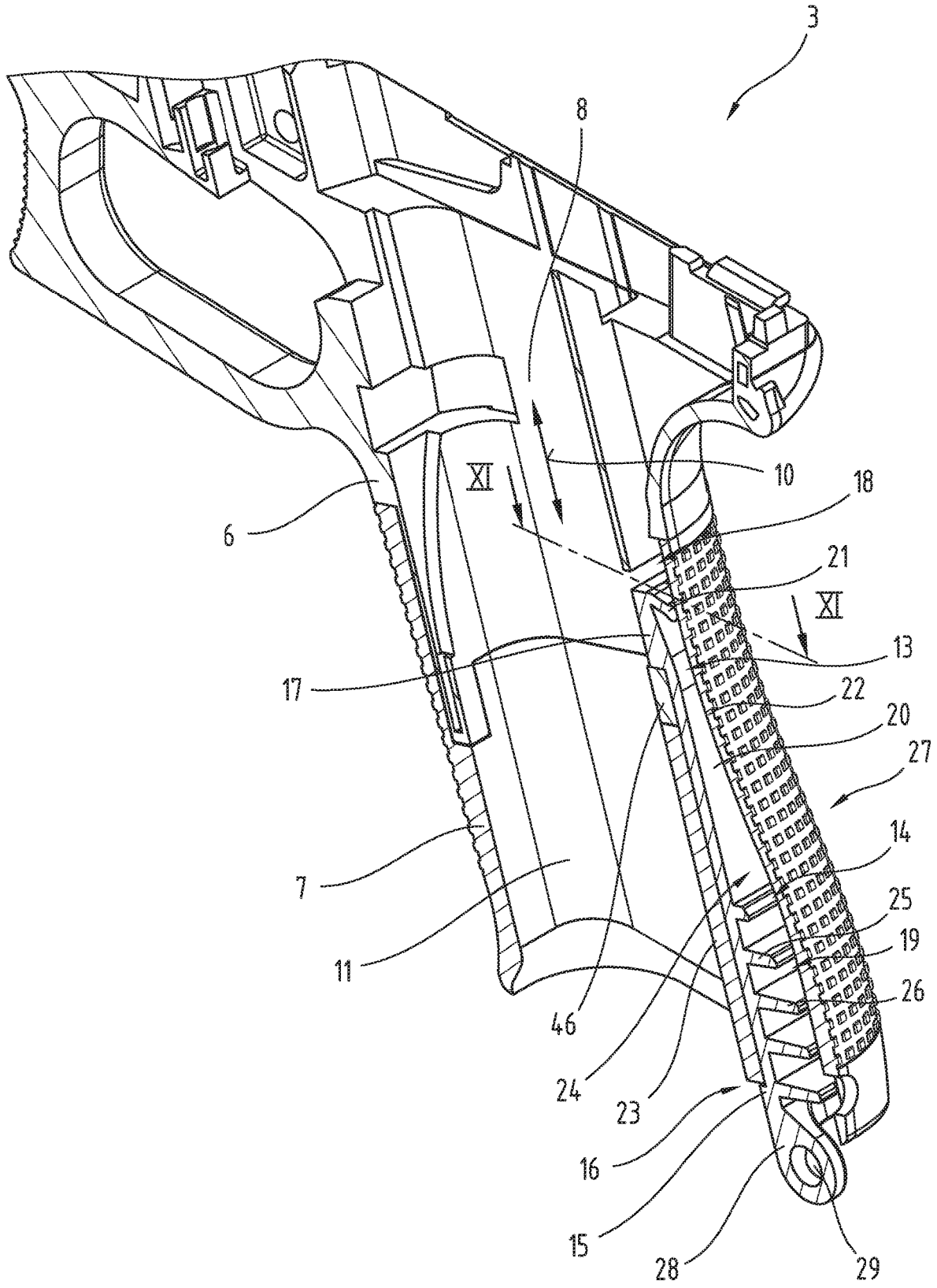
FIG. 2 shows a first perspective longitudinal sectional view of a first embodiment of a receiver of the handgun.

FIG. 2 shows the receiver assembly 3 of the handgun 1 in a perspective sectional view along the section line II-II in FIG. 1, wherein the same reference numerals or component designations as in the previous FIG. 1 are used for the same parts. In order to avoid unnecessary repetition, reference is made to the detailed description in the preceding FIG. 1.

In FIG. 2, the magazine compartment 8 of the upper receiver portion 6 and the magwell 11 of the lower receiver portion 7 are clearly visible. The extent of the magazine entry direction 10 can also be clearly seen in FIG. 2. As can also be seen from FIG. 2, provision can be made for a locking mechanism 13 to be formed, which can serve to detachably couple the lower receiver portion 7 to the upper receiver portion 6.

The locking mechanism 13 can comprise a locking element 14 which is structurally independent. The locking element 14 can have a contact projection 15 which can engage in the lower receiver portion 7 in a form-fitting manner. In particular, it can be provided that the lower receiver portion 7 has a contact recess 16 that corresponds to the contact projection 15. The contact projection 15 can bear against the contact recess 16.

Furthermore, it can be provided that the locking element 14 has an elongate extent and extends in the magazine entry direction 10 to the upper receiver portion 6. Provision can furthermore be made for the locking element 14 to have a locking projection 17 which engages in the upper receiver portion 6 in a form-fitting manner. In particular, provision can be made for a locking recess 18, in which the locking projection 17 engages, to be formed in the upper receiver portion 6.

The locking element 14 can be designed in the form of a leaf spring which has a spring base 19 and a spring arm 20 adjoining it. In particular, it can be provided that the contact projection 15 is formed on the spring base 19. Provision can also be made for the locking projection 17 to be formed on the spring arm 20. Due to the elasticity of the spring arm 20, it can be bent. As a result, the locking projection 17 can be displaced relative to the spring base 19, as a result of which the locking projection 17 can be pushed out of the locking recess 18 if necessary in order to allow the lower receiver portion 7 to be released from the upper receiver portion 6.

Provision can also be made for a further spring arm 21 to be arranged in the region of the locking projection 17. The other spring arm 21 can be supported on an outer casing 22 of the lower receiver portion 7. In particular, provision can be made for the locking projection 17 to be pressed into the locking position by the spring force of the spring arm 20 and additionally by the spring force of the further spring arm 21.

In particular, provision can be made for the spring arm 20 and the further spring arm 21 to be under pretension when the receiver assembly 3 is in the assembled state, as is shown in FIG. 2. This can be achieved in that, in the unloaded state of the locking element 14, the spring arm 20 has a slight curvature in the direction in which the locking projection 17 is arranged. In addition, the further spring arm 21 can have such a great length that it is slightly pre-bent in the installed state as shown in FIG. 2.

Provision can also be made for an intermediate wall 23 to be formed in the lower receiver portion 7. The intermediate wall 23 can serve to hold the locking element 14 in place. Furthermore, it can be provided that the contact recess 16 is arranged on the intermediate wall 23.

Furthermore, it can be provided that the intermediate wall 23 and the outer casing 22 form or delimit a receiving space 24 which serves to receive the locking element 14. In other words, the intermediate wall 23 can separate the receiving space 24 from the magwell 11.

Furthermore, a first support element 25 can be formed on the spring base 19 opposite the contact projection 15. When the locking element 14 is in the inserted state, the first support element 25 can bear against the outer casing 22 of the lower receiver portion 7. Furthermore, a second support element 26 can be formed, which can be arranged parallel to the first support element 25. As can also be seen from FIG. 2, provision can be made for additional support elements to be formed on the locking element 14.

The support elements 25, 26 can have a rib-like shape and can be arranged at right angles to the longitudinal extension of the locking element 14 or to the magazine entry direction 10. In addition, the support elements 25, 26 can extend in a transverse direction of the handgun 1. In particular, it can be provided that the support elements 25, 26 are designed in such a way that the spring base 19 of the locking element 14 is clamped or accommodated in a form-fitting manner between the outer casing 22 and the intermediate wall 23 of the lower receiver portion 7. The functionality of the spring element 14 can be improved by this measure. In addition, the penetration of foreign bodies or dirt from below into the receiving space 24 can be made more difficult.

In an alternative embodiment, it is possible to form at least part of the support elements 25, 26 parallel to the longitudinal extension of the locking element 14. In this way, space can be created in the receiving space 24 for, for example, a rechargeable battery 59, as also described in more detail below in the description of the drawings in FIGS. 8 and 9. In such an embodiment, the locking element 14 can thus serve as a holder for the rechargeable battery 59, such as button cells, AAA batteries, or specially shaped rechargeable batteries.

As can also be seen from FIG. 2, it can be provided that the receiving space 24 is arranged on a rear receiver side 27. Provision can also be made for a fastening tab 28 to be formed on the locking element 14. The fastening tab 28 can have a fastening bore 29. In particular, it can be provided that the fastening tab 28 is arranged next to the spring base 19. As can be seen from FIG. 2, provision can be made for the fastening tab 28 to protrude from the receiving space 24 and thus be accessible from the outside. The fastening tab 28 can be used to grip the locking element 14 and thus to remove the locking element 14. The fastening bore 29 can also be used to fasten or secure the handgun 1 to the user.

FIG. 3 shows a further exploded perspective view of the handgun 6, wherein the same reference numerals or component designations are used for the same parts as those in the preceding FIGS. 1 and 2. In order to avoid unnecessary repetition, reference is made to the detailed description in the preceding FIGS. 1 and 2.

Figure 4:
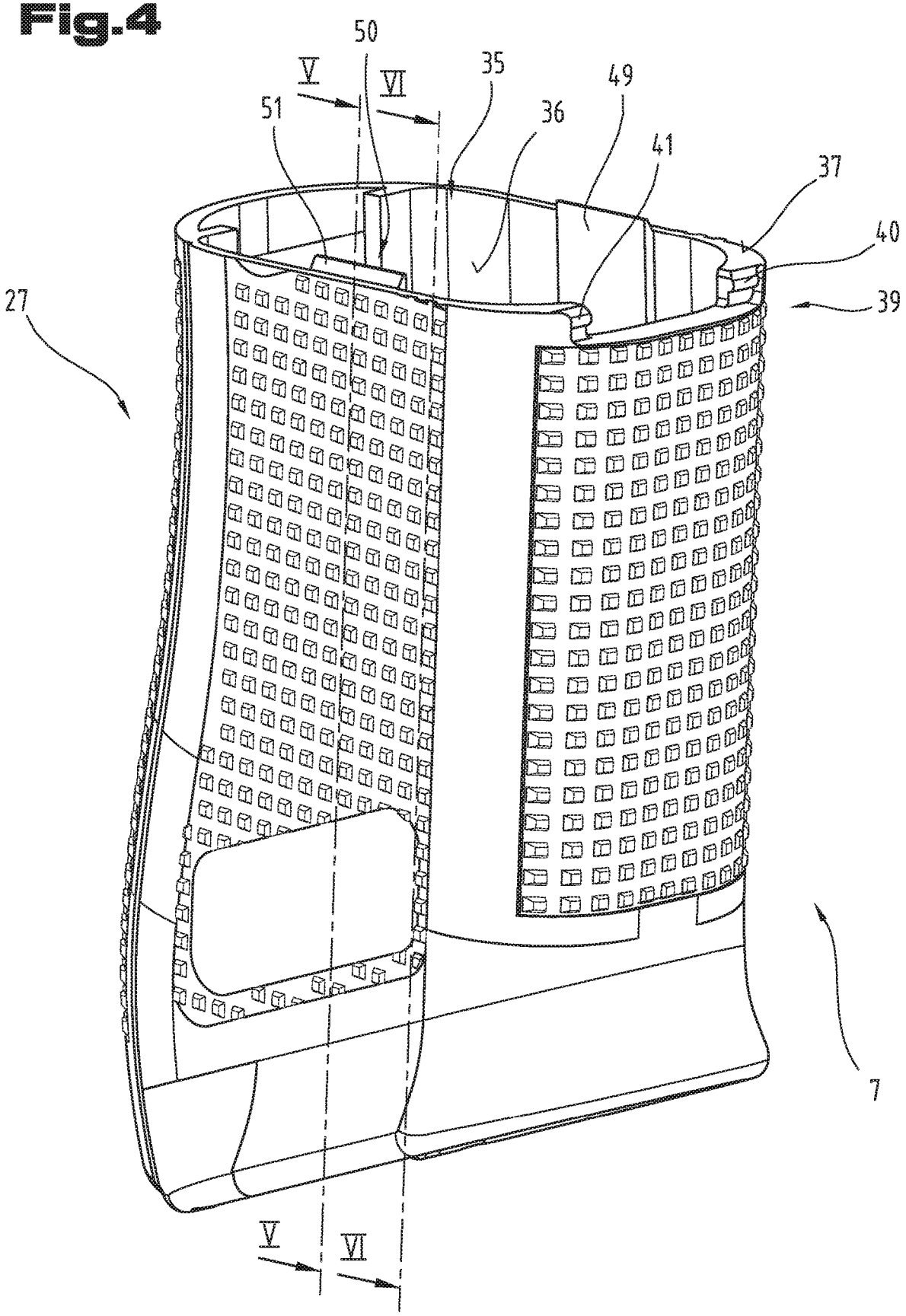
FIG. 4 shows a first perspective view of the first embodiment of the receiver base of the handgun.

FIG. 4 shows a perspective view of the lower receiver portion 7, wherein the same reference numerals or component designations are used for the same parts as those in the preceding FIG. 1 to 3. In order to avoid unnecessary repetition, reference is made to the detailed description in the preceding FIG. 1 to 3.

At this point, it is pointed out that, for the sake of clarity, in the illustration according to FIG. 4 the lower receiver portion 7 is shown rotated by 180° about the vertical axis or the magazine entry direction 10. The rear receiver side 27 is thus located on the right-hand side in the illustration according to FIG. 3 and on the left-hand side in the illustration according to FIG. 4. The further description of the receiver assembly 3 is based on an overview of FIG. 1 to 4.

As can be seen from FIG. 3, provision can be made for the upper part 6 of the receiver to have a peripheral stop 30. In particular, it can be provided that a hollow cylinder portion 31 is formed on the upper part 6 of the receiver, which extends from a lower edge 32 of the upper receiver portion 6 to the peripheral stop 30.

The hollow cylinder portion 31 can in this case have an outer lateral surface 34. Furthermore, it can be provided that the lower receiver portion 7 has an insertion space 35 into which the hollow cylinder portion 31 of the upper receiver portion 6 can be inserted. In particular, it can be provided that the insertion space 35 of the lower receiver portion 7 has an inner lateral surface 36. In the coupled state of the upper receiver portion 6 and the lower receiver portion 7, the outer lateral surface 34 of the hollow cylinder portion 31 can bear against the inner lateral surface 36 of the lower receiver portion 7. A form-fitting connection between the upper receiver portion 6 and the lower receiver portion 7 can thus be achieved. Furthermore, it can be provided that in the assembled state an upper edge 37 of the lower receiver portion 7 rests against the stop 30 of the upper receiver portion 6. Thus, the position of the lower receiver portion 7 can be defined relative to the upper receiver portion 6 in the magazine entry direction 10. As can be seen from FIG. 3, it can be provided that the stop 30 is largely arranged in a stop plane 38. The stop 30 can preferably have a gradation on a front side 39 of the receiver.

Figure 7:
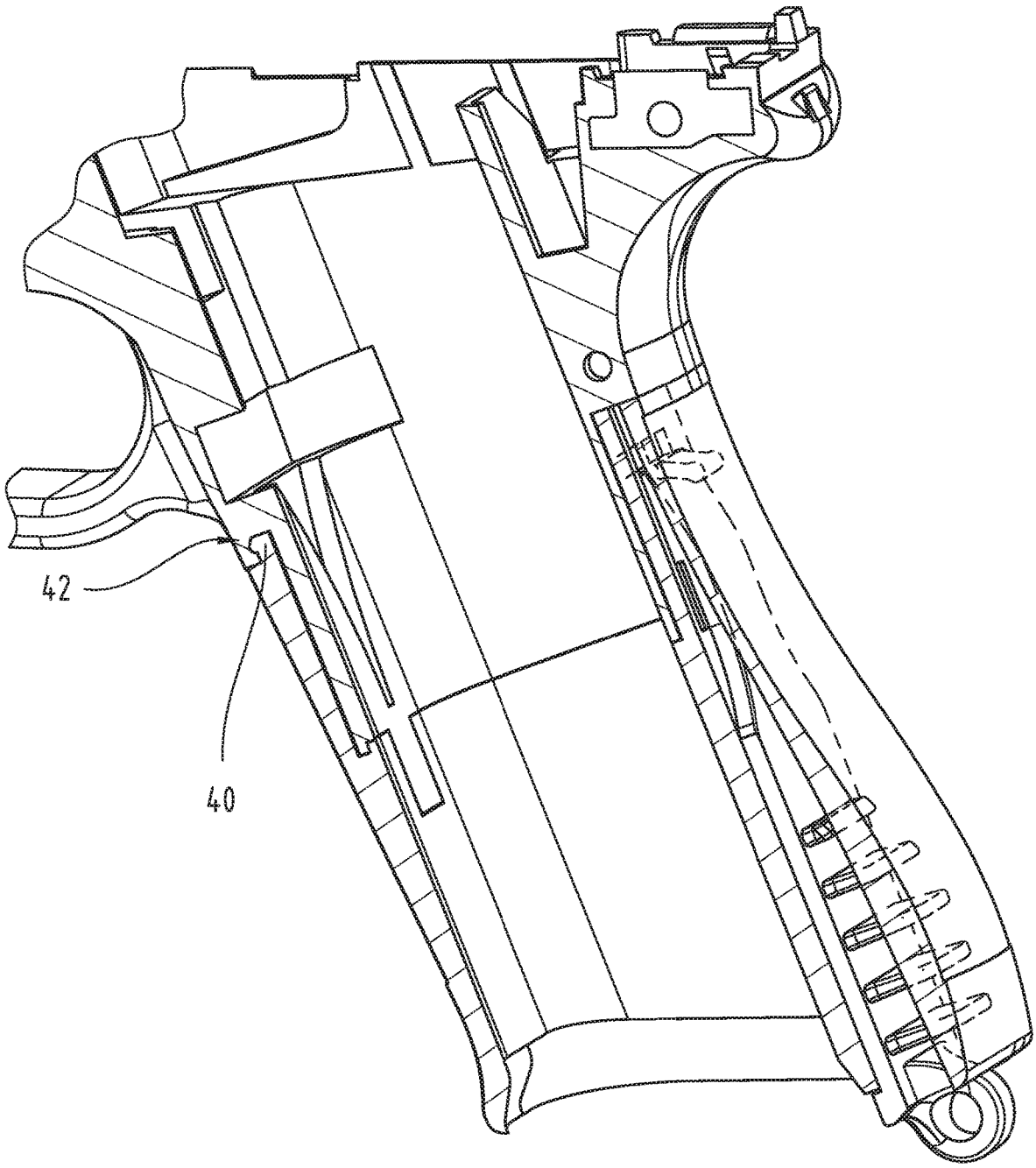
FIG. 7 shows a second perspective longitudinal sectional view of the first embodiment of the receiver of the handgun.

In particular, it can be provided that a left latching lug 40 and a right latching lug 41 are formed on the front receiver side 39 of the lower receiver portion 7. Correspondingly, a left-hand latching recess 42 and a right-hand latching recess 43 can be arranged on a front receiver side 39 of the upper receiver portion 6. See also the sectional view in FIG. 7 for comparison.

Due to the perspective view in FIG. 3, the right-hand latching recess 43 is not visible in this view. As can be seen from FIGS. 4 and 7, provision can be made for the latching lugs 40, 41 to be arranged in the region of the upper edge 37 of the lower receiver portion 7. Furthermore, the latching recesses 42, 43 can be arranged in the region of the stop 30 of the upper receiver portion 6.

As can also be seen from FIG. 3, provision can be made for the locking recess 18 to be arranged in the hollow cylinder portion 31. The locking recess 18 can penetrate through the outer lateral surface 34 of the hollow cylinder portion 31 and extend to the magazine compartment 8. In particular, it can be provided that the locking recess 18 has a recess width 44 and a recess height 45. The locking recess 18 can thus have a rectangular cross section.

As can be seen from FIG. 3, provision can be made for the hollow cylinder portion 31 to have an intermediate wall extension 46 between the lower edge 32 and the locking recess 18, which intermediate wall extension can have an increased wall thickness. The intermediate wall extension 46 can have the same wall thickness as the intermediate wall 23 of the lower receiver portion 7. Thus, the intermediate wall extension 46 can be formed flush with the intermediate wall 23 or bear against it.

As can also be seen from FIG. 3, it can be provided that a left-hand guide groove 47 and a right-hand guide groove 48 are formed on the outer lateral surface 34 of the hollow cylinder portion 31. Correspondingly, a left-hand guide projection 49 and a right-hand guide projection 50 can be formed on the inner lateral surface 36 of the lower receiver portion 7.

Furthermore, it can be provided that the guide projection 49, 50 protrudes in relation to the upper edge 37 of the lower receiver portion and a gradation 51 is thereby formed. The gradation 51 can engage in a corresponding notch 52 in the upper receiver portion 6. In particular, it can be provided that the gradation 51 of the lower receiver portion 7 is wedge-shaped. Correspondingly, the notch 52 in the upper receiver portion 6 can also be wedge-shaped. In particular, it can be provided that the wedge surface of the gradation 51 is designed to be open to the outside, so that, in the assembled state, the inner lateral surface 36 of the lower receiver portion 7 is pressed against the outer lateral surface 34 of the hollow cylinder portion 31 of the upper receiver portion 6.

Figure 5:
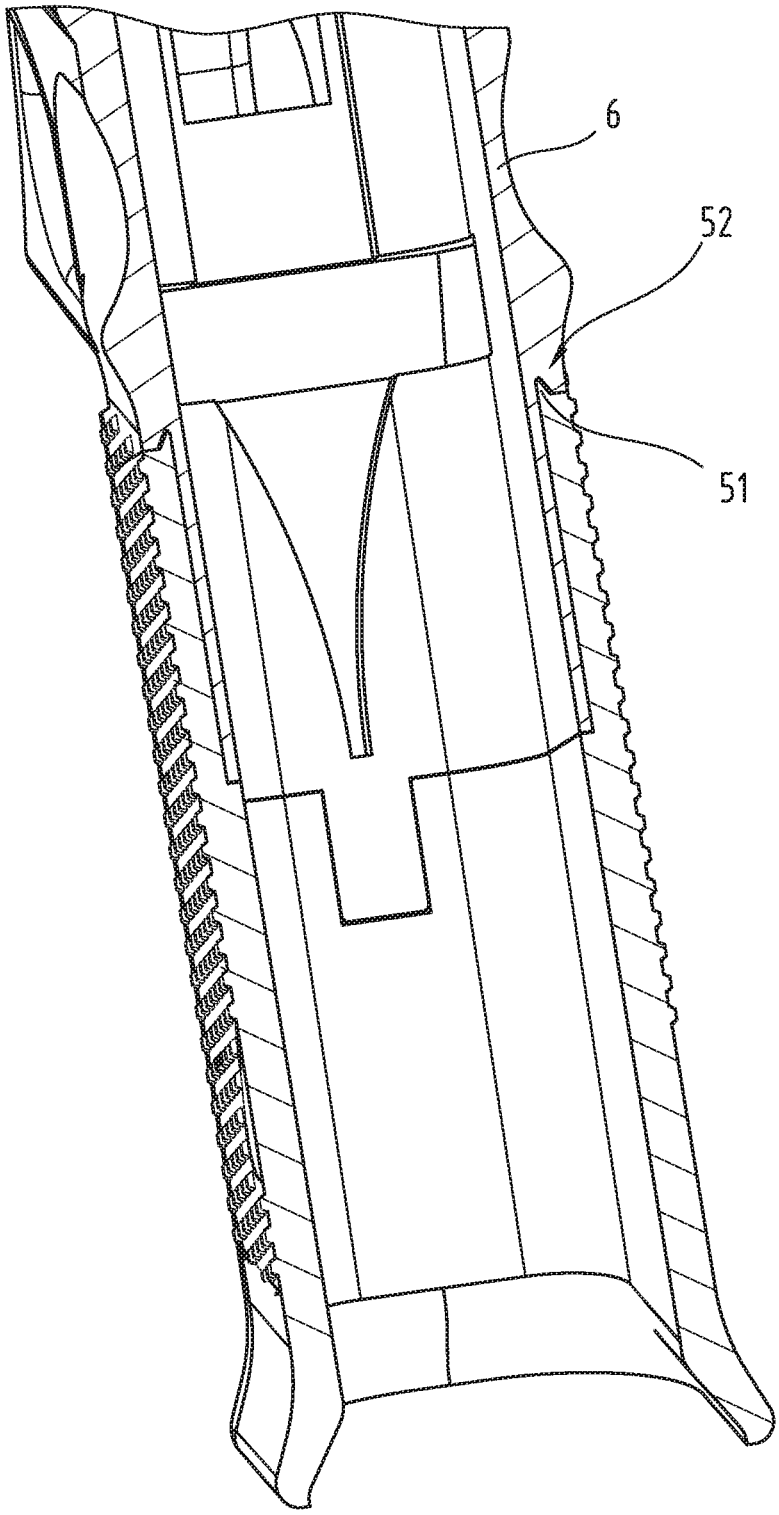
FIG. 5 shows a sectional view of the lower receiver portion joined to the upper receiver portion according to section line V-V in FIG. 4.

FIG. 5 shows a perspective sectional view of the handgun 1 according to section V-V in FIG. 4, wherein the same reference numerals or component designations are used for the same parts as those in the preceding FIG. 1 to 4. In order to avoid unnecessary repetition, reference is made to the detailed description in the preceding FIG. 1 to 4.

In the sectional view according to FIG. 5, the function of the gradation 51 or the notch 52 can be seen particularly well.

Figure 6:
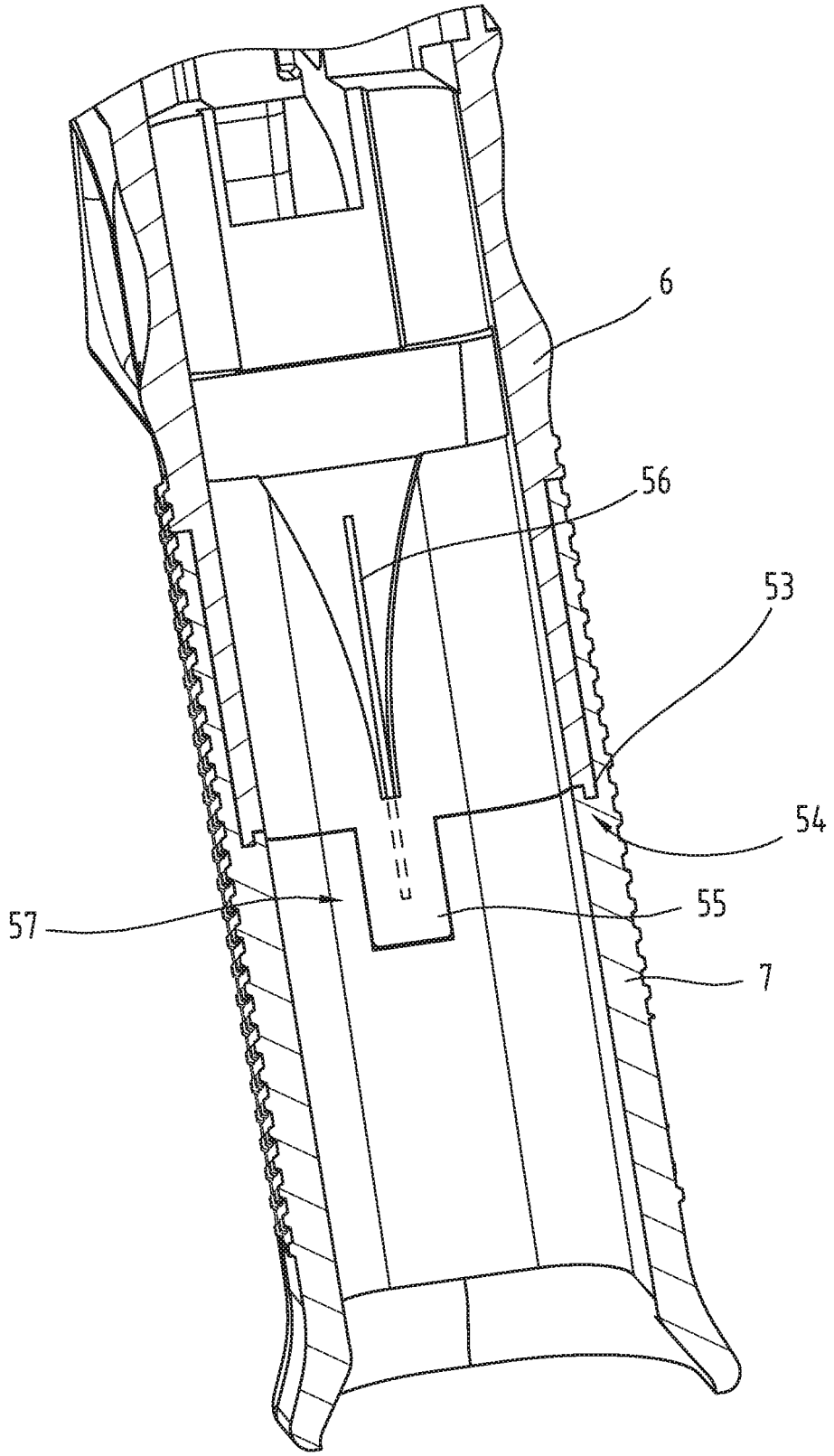
FIG. 6 shows a sectional view of the lower receiver portion joined to the upper receiver portion according to section line VI-VI in FIG. 4.

FIG. 6 shows a perspective sectional view of the handgun 1 according to section VI-VI in FIG. 4, wherein the same reference numerals or component designations are used for the same parts as those in the preceding FIG. 1 to 4. In order to avoid unnecessary repetition, reference is made to the detailed description in the preceding FIG. 1 to 4.

As can be seen from FIG. 6, provision can be made for a gradation 53 to be formed on the lower edge 32 of the upper receiver portion 6. The gradation 53 can also correspond to a notch 54 arranged in the lower receiver portion 7 and form a form-fitting connection.

As can also be seen from FIG. 6, provision can be made for a receiving block 55 to be formed in the upper receiver portion 6, which is used to receive a spring 56 which is used to reset a magazine holder. In particular, it can be provided that the spring 56 is received in the receiving block 55. Provision can also be made for a recess 57 to be formed in the lower receiver portion 7 into which the receiving block 55 can protrude. In particular, provision can be made for the receiving block 55 to protrude in relation to the lower edge 32 of the upper receiver portion 6. The receiving block 55 can be arranged on the front receiver side 39.

Figure 9:
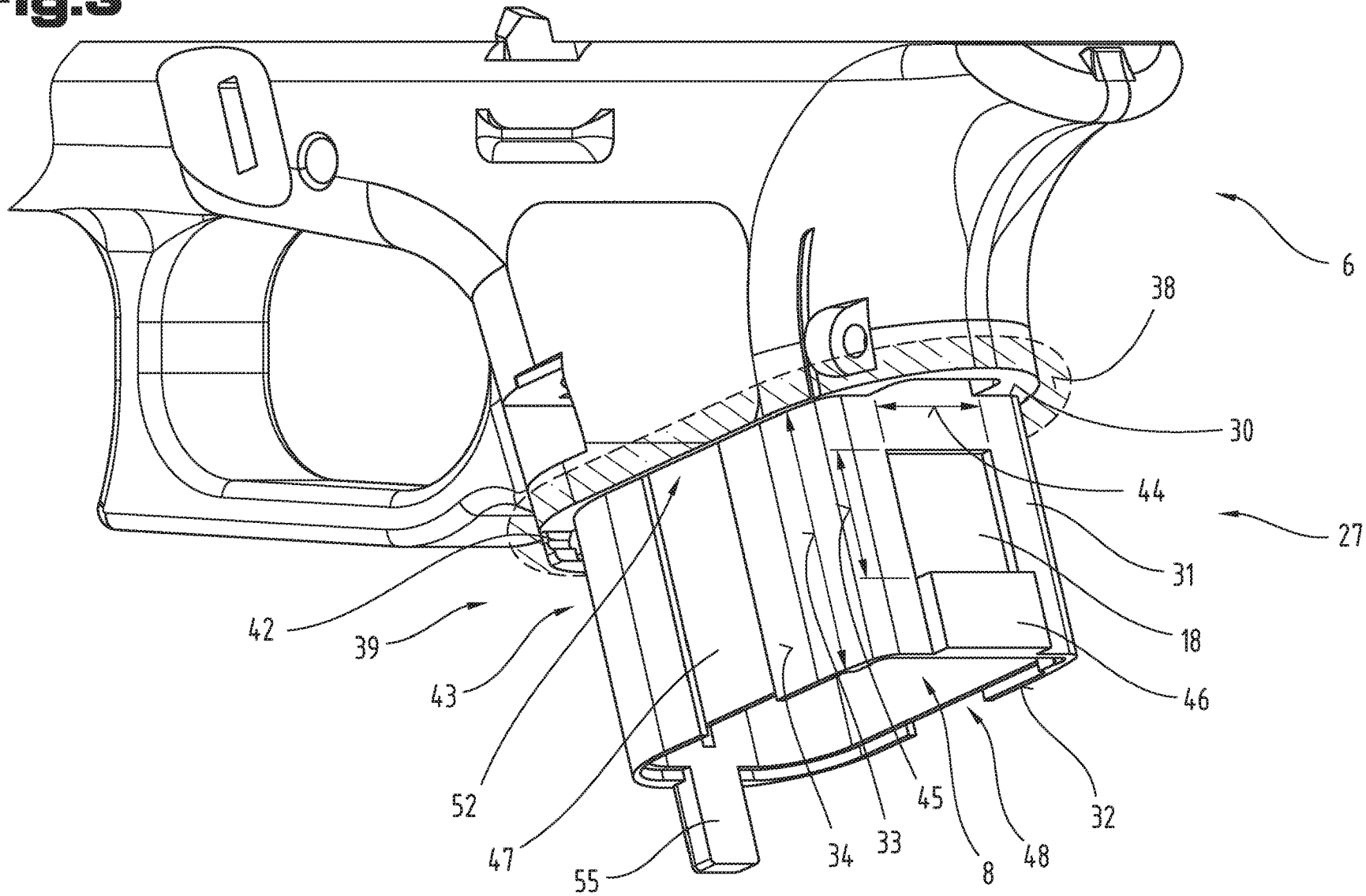
FIG. 9 shows a second perspective view of the locking element.
Figure 8:
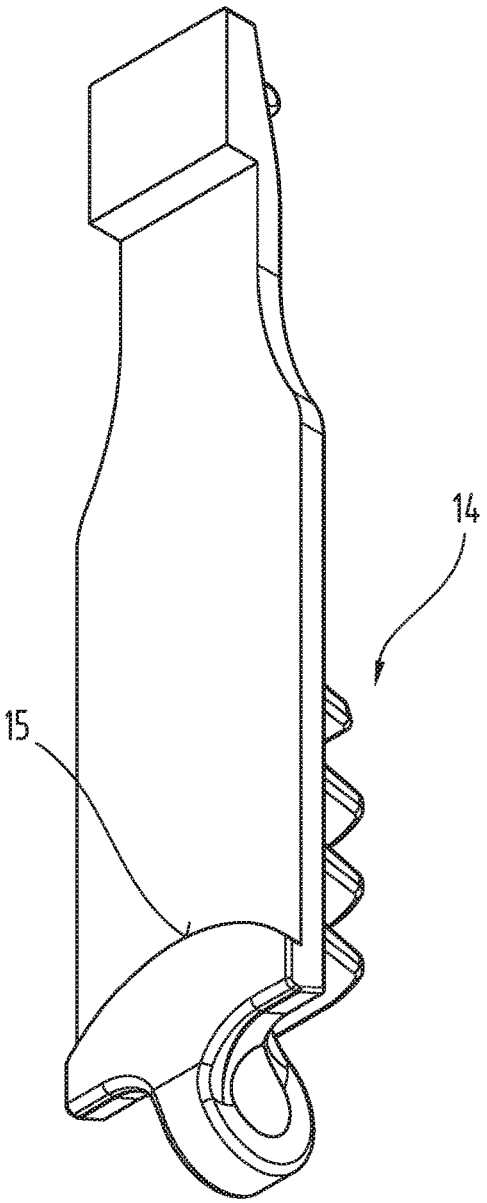
FIG. 8 shows a first perspective view of a locking element.
Figure 9:
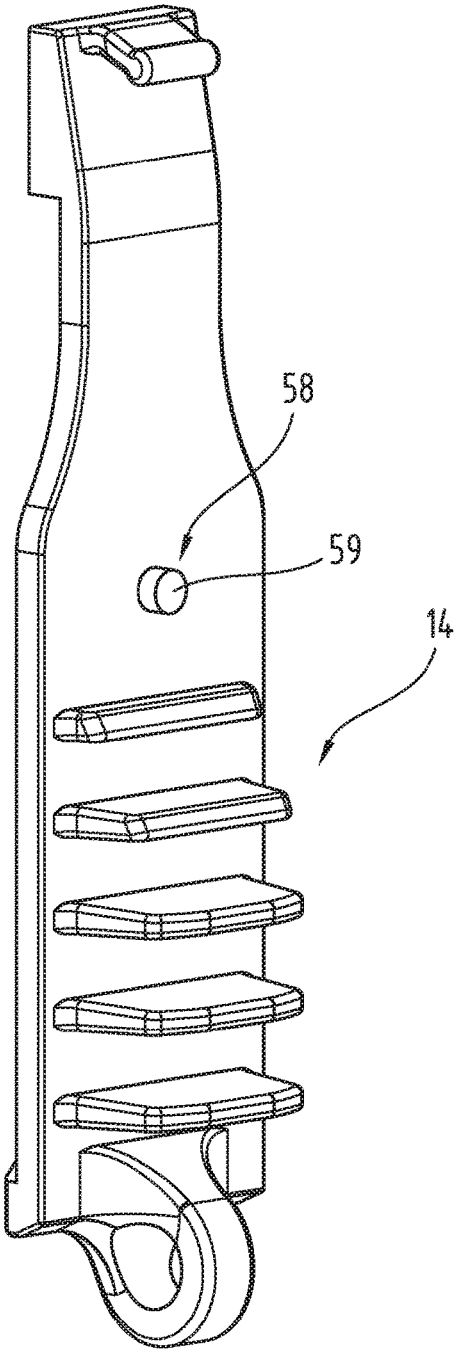

The locking element 14 is shown in FIG. 8 in a perspective view and in FIG. 9 in a second perspective view, wherein the same reference numerals or component designations are used for the same parts as those in the preceding FIG. 1 to 7. In order to avoid unnecessary repetition, reference is made to the detailed description in the preceding FIG. 1 to 7.

As can be seen from FIG. 8, it can be provided that the contact projection 15 is formed as an arc shape. Correspondingly, the corresponding contact recess 16 in the lower receiver portion 7 can of course also be designed in an arc shape. An improved centering of the locking element 14 in the receiving space 24 can be achieved by the arc shape.

As can be seen from FIG. 9, it can be provided that a rechargeable battery receptacle 58 is optionally formed on the locking element 14 and serves to accommodate a rechargeable battery 59. The rechargeable battery 59 is shown here as a button cell only by way of example, it also being possible for other forms of rechargeable batteries 59 to be held by a correspondingly designed locking element 14. When the locking element 14 is inserted, the rechargeable battery 59 can make contact with a power contact arranged in the receiver 5 in order to be able to supply the receiver 5 or end consumers that can be electrically connected to it with power.

Figure 10:
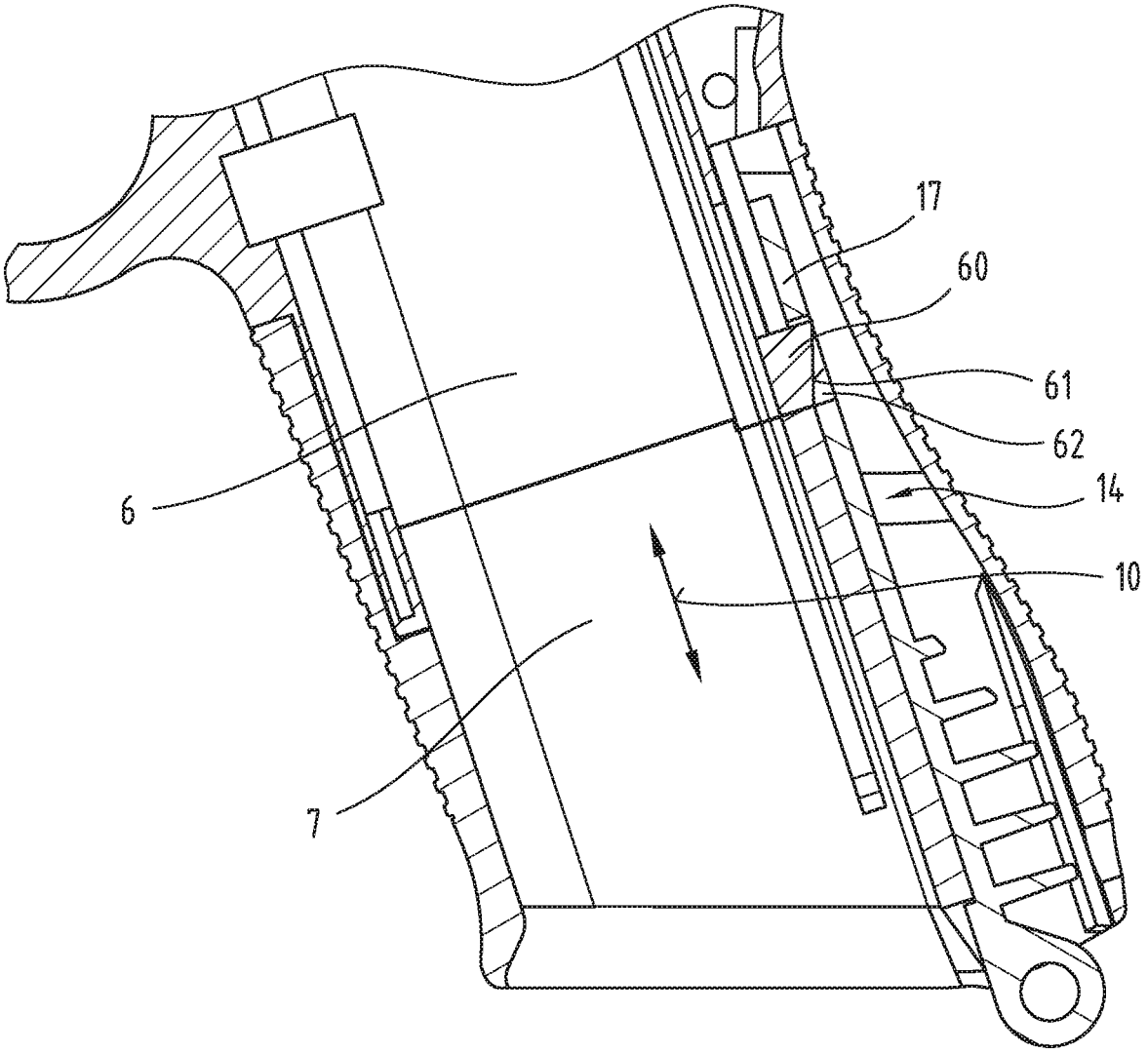
FIG. 10 shows a longitudinal sectional view of another embodiment of the receiver of the handgun.

FIG. 10 shows a sectional view of a further embodiment of the handgun 1 according to section II-II in FIG. 1, wherein the same reference numerals or component designations are used for the same parts as those in the preceding FIG. 1 to 9. In order to avoid unnecessary repetition, reference is made to the detailed description in the preceding FIG. 1 to 9.

As can be seen from FIG. 10, provision can be made for a latching lug 60 to be formed on the upper receiver portion. The latching lug 60 can have a latching ramp 61. Furthermore, a window 62 can be formed in the locking element 14, which corresponds to the latching lug 60. In particular, provision can be made for the latching lug 60 to protrude into the window 62 when the locking element 14 is in the latched state. As a result, the locking projection 17 of the locking element 14 can be formed. When the locking element 14 is pushed into its latching position, the locking element 14 can slide off the latching ramp 61, as a result of which it is lifted and can be moved into its locking position. As soon as the locking element 14 arrives in the locking position, the window 62 can fall over the latching lug 60 due to the spring preload and the locked state can thus be established. As a result, the lower receiver portion 7 can be fixed relative to the upper receiver portion 6 in the magazine entry direction 10.

Figure 11:
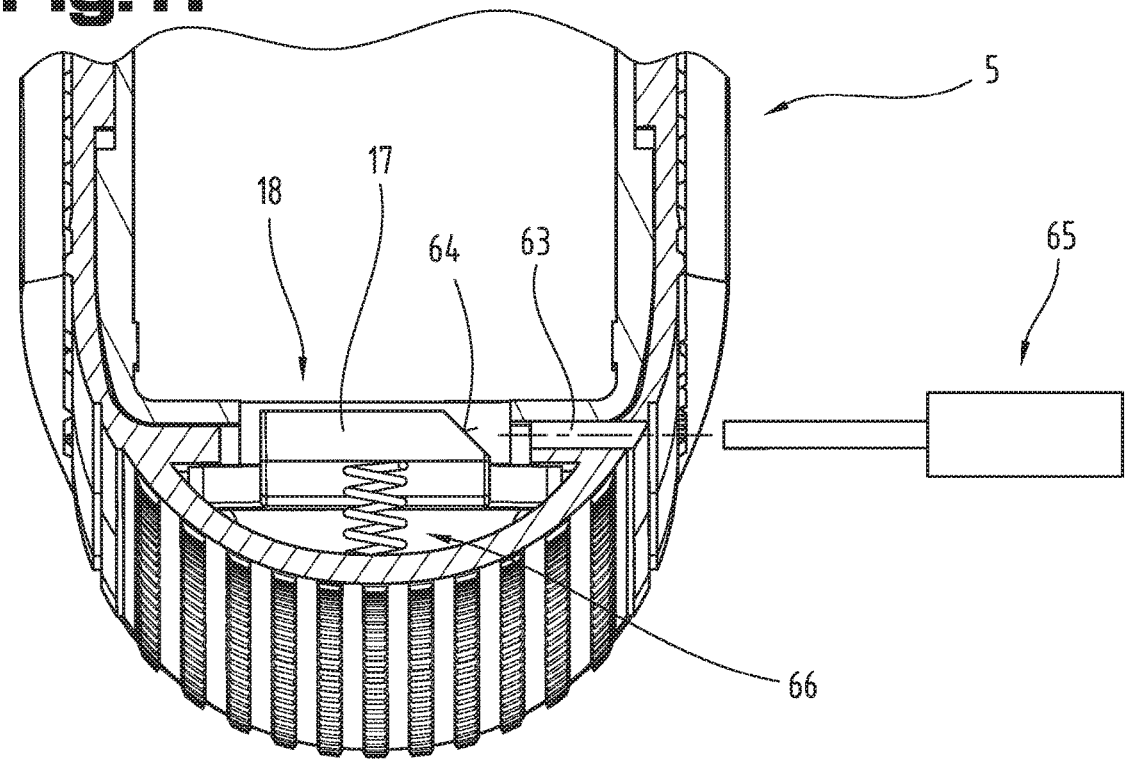
FIG. 11 shows a sectional view of another embodiment of the receiver of the handgun.

FIG. 11 shows the receiver 5 in a sectional representation according to the section line XI-XI in FIG. 2, wherein the same reference numerals or component designations as in the preceding FIG. 1 to 10 are used again for the same parts. In order to avoid unnecessary repetition, reference is made to the detailed description in the preceding FIG. 1 to 10.

As can be seen from FIG. 11, provision can be made for a bore 63 which extends in a transverse direction and opens into the region of the locking recess 18 to be formed in the upper receiver portion 6 or in the lower receiver portion 7. Provision can also be made for a bevel 64 to be formed on the locking projection 17. In the case of a handgun 1 designed in this way, the bevel 64 can be contacted through the bore 63 by means of a tool 65, whereby the locking projection 17 can be disengaged from the locking recess 18 and the locking element 14 can thereby be removed.

As can also be seen from FIG. 11, it can be provided that instead of the additional spring arm 21, a structurally independent spring element 66 is provided, which can serve to increase the pressing force of the locking projection 17 in its locking position. The spring element 66 can be designed, for example, in the form of a helical spring. As an alternative to this, it is also conceivable that the spring element 66 is designed in the form of a leaf spring. In particular, provision can be made for the spring element 66 to be accommodated in the lower receiver portion 7. Such an embodiment of the spring element 66 can of course also be accommodated on the locking element 14. The spring element 66 can also have shapes such as a clip spring or the like and fulfill the stated purpose.

Figure 12:
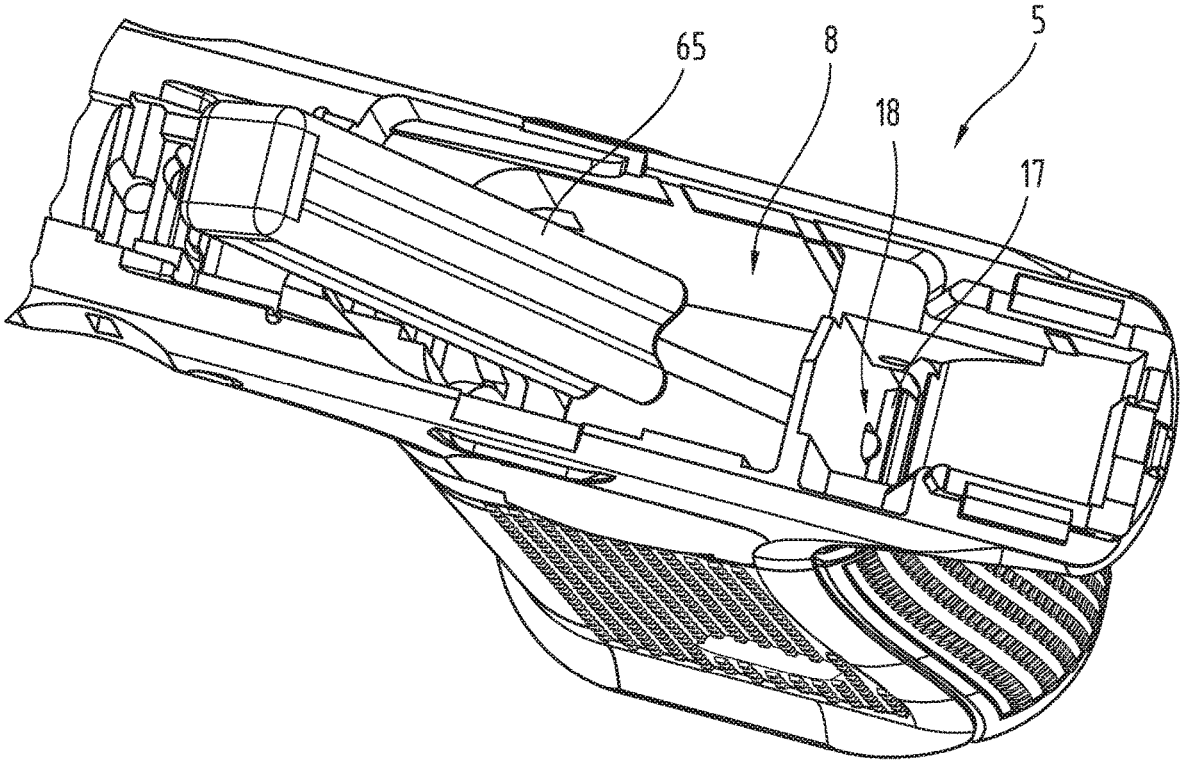
FIG. 12 is a perspective view of an embodiment of the receiver with a tool for opening the locking element.

FIG. 12 shows a further embodiment of the receiver assembly 5, wherein the same reference numerals or component designations as in the preceding FIG. 1 to 11 are again used for the same parts. In order to avoid unnecessary repetition, reference is made to the detailed description in the preceding FIG. 1 to 11.

As can be seen from FIG. 12, provision can be made for the locking recess 18 to be designed in such a way that the locking element 14 can be pressed out of its locking position by means of the tool 65 from the magazine compartment 8. In particular, it can be provided that the tool 65 can contact the locking projection 17 through the locking recess 18.

The position details chosen in the description, such as, for example, top, bottom, side, etc., relate to the position of the handgun 1 shown in FIG. 1. The front in this case is on the left side of FIG. 1, and thus at the muzzle of the barrel. A longitudinal direction extends parallel to barrel 4. A transverse extension or transverse direction extends in the width of the handgun transversely to the longitudinal direction.

The embodiments show possible design variants, whereby it should be noted at this point that the invention is not limited to the specifically illustrated design variants of the same, but rather various combinations of the individual design variants with one another are possible, and this possibility of variation based on the teaching for technical action by the present invention lies within the ability of the skilled person working in this technical field.

The scope of protection is determined by the claims. However, the description and the drawings are to be used to interpret the claims. Individual features or combinations of features from the different embodiments shown and described can represent independent inventive solutions. The object on which the independent inventive solutions are based can be found in the description.

All information on value ranges in the present description is to be understood in such a way that it includes any and all sub-ranges thereof, e.g. the information 1 to 10 is to be understood in such a way that all sub-ranges, starting from the lower limit 1 and the upper limit 10, are also included, that is, all sub-ranges begin with a lower limit of 1 or greater and end at an upper limit of 10 or less, for example 1 to 1.7, or 3.2 to 8.1, or 5.5 to 10.

Finally, for the sake of order, it should be noted that for a better understanding of the construction, elements have been partly shown not to scale and/or enlarged and/or made smaller.

The invention claimed is:

1. A receiver assembly for a handgun, the receiver assembly comprising:

a upper receiver portion having i) a guide rail for receiving a slide assembly and ii) a magazine compartment for receiving a magazine, wherein the magazine compartment defines a magazine insertion direction, and wherein the magazine is pushable into the magazine compartment in the magazine insertion direction;

a lower receiver portion slidable onto the upper receiver portion in the magazine insertion direction; and a locking mechanism configured to couple the lower receiver portion to the upper receiver portion, wherein the locking mechanism comprises a locking element that is structurally independent, the locking element comprises:

a contact projection that form-fittingly engages with the lower receiver portion; and a locking projection that form-fittingly engages with the upper receiver portion.

2. The receiver assembly of claim 1 wherein the locking element comprises a leaf spring having a spring base and a spring arm, and wherein i) the contact projection is arranged on the spring base, ii) the locking projection is arranged on the spring arm, and iii) the spring arm is elastically bendable.

3. The receiver assembly of claim 2, wherein the locking element includes a further spring arm formed thereon by the locking projection, wherein the further spring arm is supported on an outer casing of the lower receiver portion.

4. The receiver assembly of claim 1, the upper portion further having a locking recess is formed therein into which the locking projection engages, wherein the locking recess extends to the magazine compartment, and wherein the locking projection is detachable from the magazine compartment.

5. The receiver assembly of claim 1, the lower receiver portion having a receiving space formed therein that receives the locking element, wherein the receiving space is constrained by an outer casing of the lower receiver portion and by an intermediate wall of the lower receiver portion.

6. The receiver assembly of claim 5, wherein one of the receiving space and the locking element includes a rechargeable battery receptacle formed therein, and wherein the rechargeable battery receptacle is configured to hold a rechargeable battery for powering the receiver assembly.

7. The receiver assembly of claim 5 wherein the receiving space is in the lower receiver portion on a rear receiver side.

8. The receiver assembly of claim 1 wherein the locking element has at least one support element formed thereon towards the contact projection, wherein the at least one support element is supported on an outer casing of the lower receiver portion.

9. The receiver assembly of claim 1, the upper receiver portion further having a stop and a hollow cylinder section, the hollow cylinder section is formed in the upper receiver portion and completely surrounds the magazine compartment and extends between a lower edge of the upper receiver portion and the stop, wherein the lower receiver portion further has an insertion space in which the hollow cylinder section is accommodated, and wherein an upper edge of the lower receiver portion rests on the stop of the upper receiver portion.

10. The receiver assembly of claim 9 further comprising:

at least one guide groove formed on an outer lateral surface of the hollow cylinder section and extending in the magazine insertion direction at least one guide projection is formed on an inner lateral surface of the lower receiver portion, wherein the at least one guide projection corresponds to the at least one guide groove when the lower receiver portion is coupled to the upper receiver portion.

11. The receiver assembly of claim 9 further comprising:

a left-hand guide groove formed on a left-hand side of the hollow cylinder section;

a right-hand guide groove formed on a right-hand side of the hollow cylinder section;

a left-hand guide projection formed on a left-hand side of the lower receiver portion, wherein the left-hand guide projection corresponds to the left-hand guide groove when the lower receiver portion is coupled to the upper receiver portion; and a right-hand guide projection formed on a right-hand side of the lower receiver portion, wherein the right-hand guide projection corresponds to the right-hand guide groove when the lower receiver portion is coupled to the upper receiver portion.

12. The receiver assembly of claim 9 further comprising:

a receiving block, in the upper receiver portion, for a return spring of a magazine holder, wherein the receiving block is configured to project downwards relative to the lower edge; and a recess formed in the lower receiver portion to receive the receiving block.

13. The receiver assembly of claim 1, wherein the locking element has a fastening tab which has a fastening bore.

14. The receiver assembly of claim 1 further comprising:

at least one latching lug formed on a front side of the lower receiver portion; and at least one latching recess of the upper receiver portion, wherein the at least one latching lug corresponds to the at least one latching recess when the lower receiver portion is coupled to the upper receiver portion.

15. A handgun comprising:

a slide assembly; and a receiver assembly configured to be coupled to the slide assembly, the receiver assembly comprising:

a upper receiver portion having i) a guide rail for receiving the slide assembly and ii) a magazine compartment for receiving a magazine, wherein the magazine compartment defines a magazine insertion direction, and wherein the magazine is pushable into the magazine compartment in the magazine insertion direction;

a lower receiver portion slidable onto the upper receiver portion in the magazine entry direction; and a locking mechanism configured to couple the lower receiver portion to the upper receiver portion, wherein the locking mechanism comprises a locking element that is structurally independent, the locking element comprises:

a contact projection that engages with the lower receiver portion; and a locking projection that engages with the upper receiver portion.

16. The handgun of claim 15, the upper portion further having a locking recess formed therein into which the locking projection engages, wherein the locking recess extends to the magazine compartment, and wherein the locking projection is detachable from the magazine compartment.

17. The handgun of claim 15 wherein the lower receiver portion includes a receiving space formed therein that receives the locking element, and wherein the receiving space is constrained by an outer casing of the lower receiver portion and by an intermediate wall of the lower receiver portion.

18. The handgun of claim 17 wherein one of the receiving space and the locking element includes a rechargeable battery receptacle formed therein, and wherein the rechargeable battery receptacle is configured to hold a rechargeable battery for powering the receiver assembly.

19. The handgun of claim 18 wherein the receiving space is in the lower receiver portion on a rear receiver side.

20. The handgun of claim 15 wherein the locking element has at least one support element formed thereon towards the contact projection, wherein the at least one support element is supported on an outer casing of the lower receiver portion.

* * * * *